United States Patent [19]

Ackermann et al.

[11] Patent Number: 4,770,556

[45] Date of Patent: Sep. 13, 1988

[54] LIPSTICK CASE

[75] Inventors: Walter T. Ackermann, Watertown; David Ramonas, Waterbury, both of Conn.

[73] Assignee: Specialty Packaging Licensing Company, Inc., Wilmington, Del.

[21] Appl. No.: 44,658

[22] Filed: May 1, 1987

[51] Int. Cl.[4] ..... A45D 40/06

[52] U.S. Cl. ..... 401/69; 401/78; 401/95

[58] Field of Search ..... 401/87, 78, 75, 68, 401/69, 95, 77

[56] References Cited

U.S. PATENT DOCUMENTS

| | | | |
|---|---|---|---|
| 1,470,994 | 10/1923 | Mason, Jr. | 401/75 |
| 2,546,195 | 3/1951 | Mellette | 206/56 |
| 2,626,047 | 1/1953 | Crane | 401/69 |
| 2,815,123 | 12/1957 | Safianoff | 401/87 |
| 2,823,796 | 2/1958 | Schwartz et al. | 401/75 |
| 4,505,607 | 3/1985 | Sugiyama | 401/78 |
| 4,616,947 | 10/1986 | Iwamoto et al. | 401/87 X |

FOREIGN PATENT DOCUMENTS

| | | | |
|---|---|---|---|
| 826715 | 1/1952 | Fed. Rep. of Germany | 401/69 |
| 3316573 | 11/1984 | Fed. Rep. of Germany | 401/69 |
| 592398 | 8/1925 | France | 401/78 |
| 2026983 | 2/1980 | United Kingdom | 401/68 |

*Primary Examiner*—Steven A. Bratlie

*Attorney, Agent, or Firm*—Dallett Hoopes

[57] ABSTRACT

A lipstick case includes a casing rotatably attached to the base, and driving means involving a "floating" sleeve which is spirally slotted and engaged both by lugs on the pomade support stem and on the base. The casing and base attach together in snap installation.

4 Claims, 2 Drawing Sheets

Fig. 1
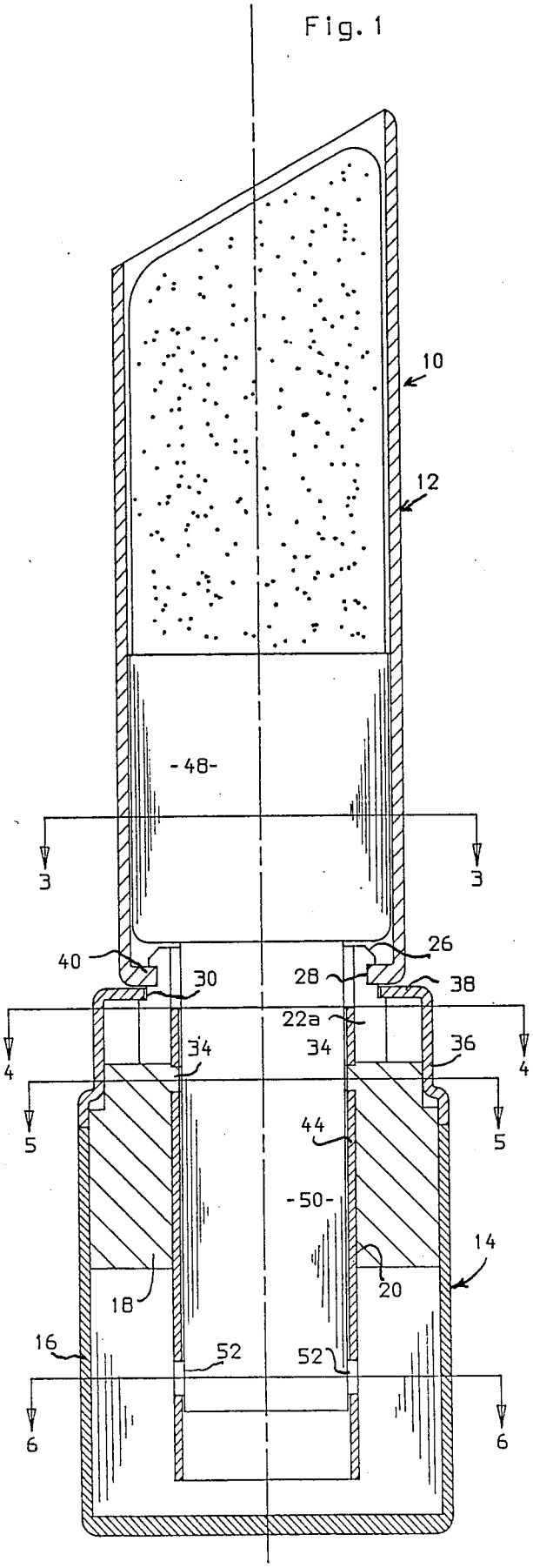
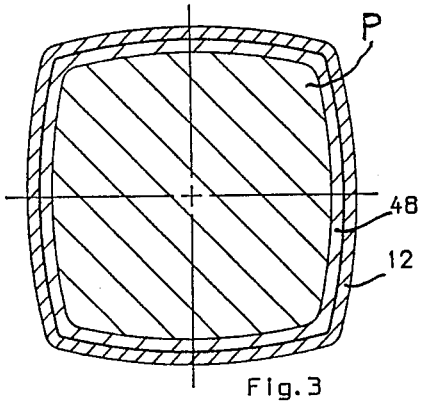
Fig. 3
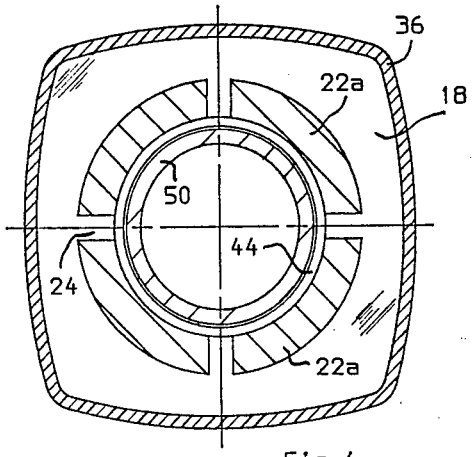
Fig. 4
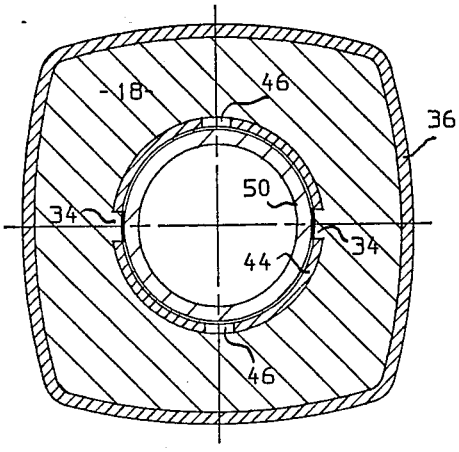
Fig. 5
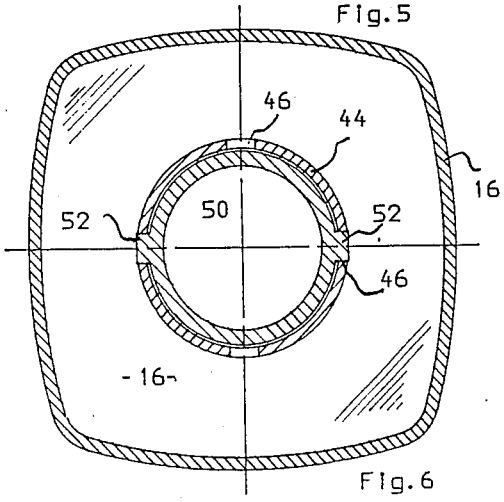
Fig. 6

LIPSTICK CASE

BACKGROUND OF THE INVENTION

1. Field of the Invention

This relates to a lipstick case of the type in which the lipstick pomade may be made to advance or retract by turning the casing relative to the base. More specifically, this invention relates to a lipstick case in which the driving means for propelling the pomade up or down is in the form of a floating spirally slotted sleeve which cooperates with lugs in the base and on the pomade support.

2. Description of the Prior Art

The prior art includes the Mellette U.S. Pat. No. 2,546,195, granted Mar. 27, 1951, wherein the driving means includes three telescoping threaded sleeves. (A copy is enclosed in accordance with 35 CFR 1.97.) With the casing held from turning, the base member secured to the outer sleeve may be turned to drive up the floating intermediate sleeve which eventually drives up the inner sleeve connected to the pomade support.

An improvement on the old Mellette device is disclosed in the Wiles et al application, Ser. No. 836,853, filed Mar. 6, 1986 now abandoned, and assigned to my assignee. This improvement, which is meritorious, relates to the structure of the molded interfitting sleeves and other aspects of construction.

A drawback of prior devices has been the complicated nature of the drive means requiring precise shaping of pairs of interfitting threads on the sleeves. Another drawback has been the relatively complicated operation necessary to rotatably join the casing and base.

SUMMARY OF THE INVENTION

Under the present invention the complicated drive means of the prior art is replaced by a simple spirally slotted sleeve. This is the only "threaded" member and hence there is no need to care about the interrelation of pairs of threads. Lugs are formed in the pomade support stem and in the base, and the lugs extend into different slots in the slotted sleeve so that as the elevation or retraction of the pomade is effected, the lugs move toward and pass each other without interference.

Without having to provide for threads on three members as in the prior art, the space for the driving members can be laterally very compact. Hence, the present structural arrangement is especially significant because it provides a virtually limitless latitude of shape possibilities. It permits variety in the shaping of the overall package to new dimensions of slenderness because the driving gear is under rather than around the pomade. Further, because the pomade does not rotate in the casing, it permits fanciful similar or contrasting longitudinal shaping of the case and pomade itself. Hence, the case and/or casing may be triangular and the pomade triangular; the case may be longitudinally fluted and the pomade likewise; the case may be square and the pomade triangular, etc.

Moreover, the attachment of the casing to the base is made possible by a simple snap installation which is not reversible. This greatly simplifies the assembly.

BRIEF DESCRIPTION OF THE DRAWINGS

Other objects and features of the invention will be apparent from reference to the following specification including the drawings, all of which disclose a non-limiting form of the invention. In the drawings:

FIG. 1 is a center line sectional elevation of a lipstick case with its cover removed and embodying the invention;

FIG. 3 is a sectional view taken on the line 3—3 of FIG. 1;

FIG. 4 is a sectional view taken on the line 4—4 of FIG. 1;

FIG. 5 is a sectional view taken on the line 5—5 of FIG. 1;

FIG. 6 is a sectional view taken on the line 6—6 of FIG. 1;

DESCRIPTION OF THE PREFERRED EMBODIMENT

Figure 2:
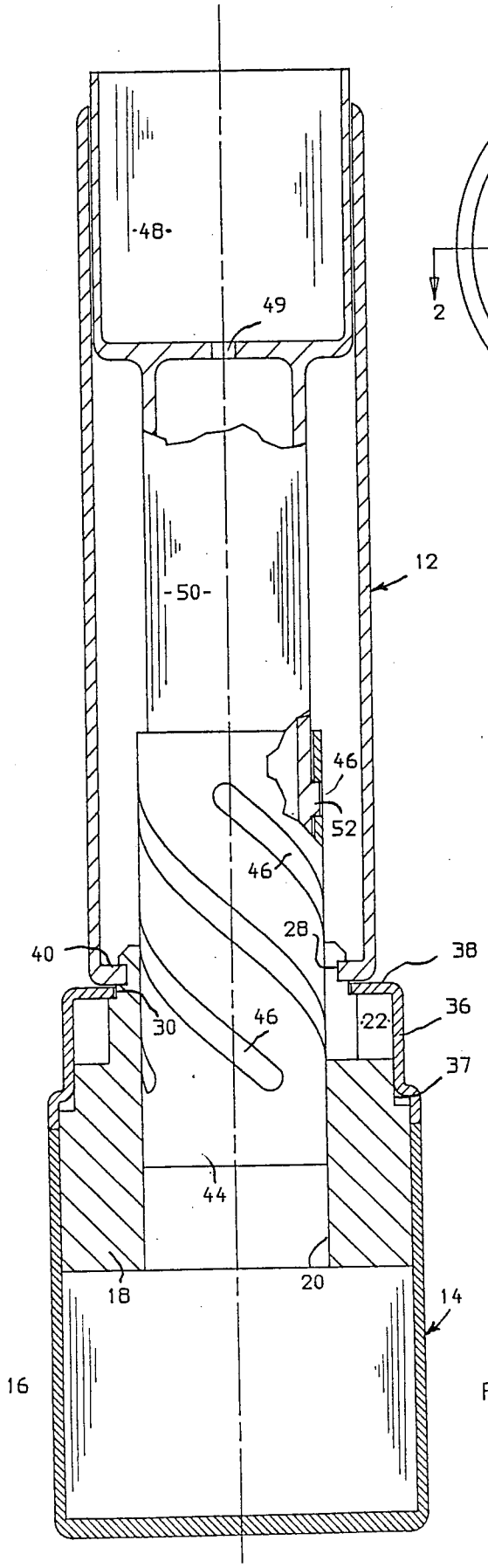
FIG. 2 is a view similar to FIG. 1 but having the pomade elevated to its maximum height and showing the slotted sleeve in profile, but having a portion thereof broken away to reveal the interfitting of a lug and the sleeve.

Referring more specifically to the drawings, a lipstick case embodying the invention is generally designated 10 in FIG. 1. It comprises a tubular metal casing 12 and a base 14. The casing is normally covered by an inverted cup-shaped metal cover (not shown). This cover has plastic fins deep inside it to grip the upper end of the casing.

The base includes a cup-shaped outer base 16 and a base insert 18 secured in the outer base. The base insert 18 is formed of plastic and has a central opening 20 which extends vertically its entire height.

It should be understood that while some of the parts of the lipstick case described have been and others will be described as of plastic or metal, indeed all parts can be either of metal or plastic, and certainly there is no limitation in this disclosure as to the material of any particular part. The material is specified herein only with respect to one preferred embodiment. Generally the material of the parts is selected to avoid metal-to-metal contact.

Figure 7:
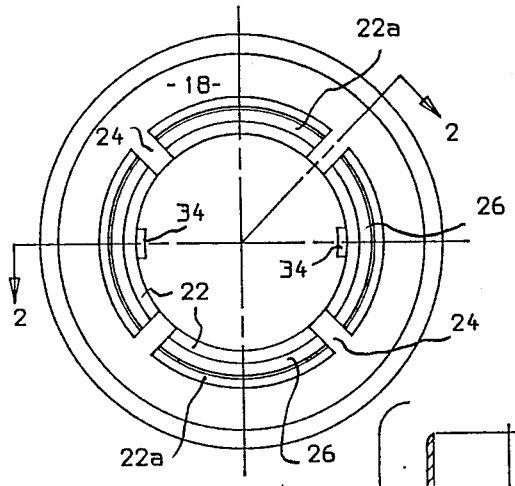
FIG. 7 is a top plan view of the base including the insert and outer member with the other parts removed.
Figure 8:
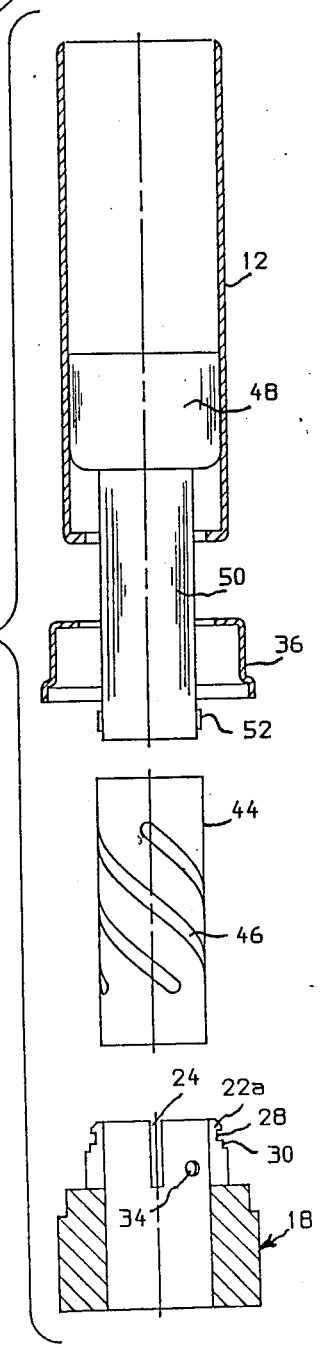
FIG. 8 is a reduced exploded view of parts of a lipstick case embodying the invention, some of which are shown in section.

Extending upward from the base (FIG. 2) is a reduced annular section 22, which is comprised of arcuate segments **22*a* (FIG. 7) which are spaced by radial slots 24. The segments are, in effect, spring fingers as will be explained. The segments as shown are formed with a lead-in chamfer 26, and thereunder the segments are formed with a peripheral groove 28 (FIG. 2) under which is formed a reduced zone 30**.

In the central opening 20 just below the segments **22*a*, a pair of inward lugs 34 is molded into the base insert. Alternatively, the lugs may extend inward from the segments themselves. The lugs may be round or trapezoidal in shape to cooperate most effectively with the slots in the sleeve 44 as will be clear later. An aesthetic collar 36 frictionally engages and is fixedly mounted on and about sidewall 37 of the stepped upper end of the base insert, and its outer periphery may be shaped to orient the cover (not shown). For instance, if the cover is square in cross section, the side of the collar may also be square. The collar 36 is formed with an inward flange 38 which fits down into the reduced zone 30**.

The casing 12, formed of tubular metal, is provided at its lower end with an annular inward flange 40 having an inside diameter intermediate the diameters of the outer and inner edges of the lead-in 26. Thus, in assembly the casing 12 may be simply pressed downward and the flange 40, engaging the lead-in 26, will cam against the arcuate segments 22 flexing them inward until the flange 40 snaps into the recess 28 in the completion of the assembly. It is this joint at which all relative movement between the casing and the base takes place: groove 28 is a bearing for flange 40.

Disposed as shown in FIG. 1, inside the opening 20 is the spirally slotted sleeve 44, which may be formed of a steel blank slotted in inclined spaced slots and rolled into sleeve form and welded at the longitudinal juncture. Preferably, as shown in FIG. 2, the slotted sleeve has four spaced spiral slots 46, and as shown in FIG. 1 the lugs 34 extend respectively into slots 46 on opposite sides of the sleeve adjacent the upper ends thereof.

A pomade support is provided and in the embodiment shown comprises a cup 48 (FIG. 2). The cup, preferably of Delrin, is formed with a vent hole 49 to permit trapped air to escape in assembly and a downward hollow tubular stem 50. The lower ends of the slots 46, which are intermediate the slots into which the lugs 34 protrude, receive a second pair of lugs 52 molded to extend outwardly at the lower end of the stem 50.

It will be clear that the lugs are in dimension smaller than the slots so that as the parts turn relatively, the lugs slide in the slots. Lugs 34 and 52 are provided in pairs as shown. While a single lug may suffice in each position, a pair provides better balance and eliminates eccentric loading which can lead to locking.

While not shown in the drawings the slots 46 may each terminate at their upper and lower ends in short horizontal extensions or other means including spring detents to provide, in effect, a lock to hold the pomade extended or retracted. This kind of lock is well known in the art.

In use, the base and the casing are rotated relatively. The sleeve 44 and the stem 50 both eventually move longitudinally. In some cases the movement will start out with the relative rotary movement between the base and the sleeve and the sleeve will start up, and then when the sleeve reaches its full height it will stop but continue to rotate and then the stem will move up in the sleeve. In other cases the movement will start with the stem moving up in the sleeve. It will depend on a number of factors including friction between the parts. In all cases eventually the cup 48 will reach its maximum height (FIG. 1).

It will be seen from FIG. 3 that the cup 46 and the casing 12 are of similar non-circular cross section, and hence there is no need to provide special projections and keyways or the like to keep the cup 48 from turning relative to the casing 12.

There are many advantages inherent in the fact that the casing does not turn relative to the pomade P. There is no circular rubbing of the pomade P by the casing (as is the situation in conventional lipstick cases) and non-circular shapes are possible. Further, because the pomade P does not turn relative to the casing, the top of the casing may be beveled off at some preferred angle at the upper end of the pomade P (FIG. 1). Another desirable feature from the structure disclosed is that the pomade can extend out to the side walls of the casing 12. This reduces the vulnerability of the pomade to fracture as the completed product is moved about in shipping and indeed in the purse of the user, even when it is dropped. Additionally, because of support offered to the pomade by the casing 12, softer and harder formulations for pomade are possible, still obtaining the advantage of the shock-resistant feature described above.

The relative stability of the pomade with respect to the casing is also enhanced by the length of the stem 50, which, firmly held in the inner base 18, virtually eliminates any lateral wobbling of the cup 48. (Lateral wobbling can cause the lipstick to touch the side wall of the case and leave an imprint on the lipstick.)

Finally, the provision of the slotted sleeve 44 disposed well underneath the pomade support permits generous use of lubricants, such as lanolin, to smooth the action of the drive means. In conventional lipstick cases where the drive surrounds the pomade, the use of lubricant must be limited because it attracts small flakes of plastic, metal or airborne debris which eventually will adhere to the pomade, making it unsalable. The inferior location of the drive means (under the pomade rather than around it) has the advantage that excess lanolin and particles that are generated by use do not find their way on to the pomade surface. In addition, the provision of the drive underneath the pomade suppport cup rather than around it permits narrower cross sections and more fashionable overall appearance.

The slotted sleeve 44 represents an important element of the invention and is the preferred form for the invention. Notwithstanding this other elements may be substituted with some of the benefits of the invention. The sleeve may be in the form of a spring, for instance, wherein the lugs move relatively between the coils as the base and the casing are turned. Also the sleeve may be of thicker stock and the lugs be less than one half its thickness so that they may track the same slot from opposite sides without interference.

Thus, while the invention has been shown in only one embodiment, it is not so limited but may take many forms. Hence, the protection herein sought should be limited only by the following claim language and its equivalents.

I claim:

1. A lipstick case having a base formed with a central opening and a tubular casing mounted rotatably on the base, a cup for pomade disposed in the casing and associated therewith for rotation together relative to the base, and drive means intermediate the base and the cup for converting relative turning between the base and casing into up or down motion of the cup, the drive means comprising a reduced stem extending down from the cup, the base having at least one inward lug in the opening adjacent its upper end and the stem having at least one outward lug adjacent its lower end, and a smooth, continuous sheet metal drive sleeve disposed inside the base opening and surrounding the stem, the sleeve having a plurality of spaced parallel helical slots, the slots receiving the lugs respectively.

2. A lipstick case as claimed in claim 1 wherein the upper end of the base is formed with an annular head of resilient material formed with a lead-in chamfer about its upper end and radial slots and the lower end of tubular casing has an inward flange with a circular opening having a diameter which aligns with the chamfer, whereby in assembly the flange of the casing snaps over the head of the base as the casing and base are axially brought together.

3. A lipstick case as claimed in claim 1 wherein the up and the casing have similar non-circular cross-sectional shapes.

4. A lipstick case as claimed in claim 1 wherein the said lugs are a pair of diametrically opposed outward lugs on the stem and a pair of diametrically opposed inward lugs on the base, the lugs on the stem and the lugs on the base extending into the slots respectively.

* * * * *